US009879866B2

(12) United States Patent
Suenaga et al.

(10) Patent No.: US 9,879,866 B2
(45) Date of Patent: Jan. 30, 2018

(54) COOKING DEVICE

(75) Inventors: Hiromi Suenaga, Osaka (JP); Shigenori Morimoto, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 965 days.

(21) Appl. No.: 13/266,243

(22) PCT Filed: Apr. 27, 2010

(86) PCT No.: PCT/JP2010/057427
§ 371 (c)(1),
(2), (4) Date: Oct. 26, 2011

(87) PCT Pub. No.: WO2010/126027
PCT Pub. Date: Nov. 4, 2010

(65) Prior Publication Data

US 2012/0043315 A1 Feb. 23, 2012

(30) Foreign Application Priority Data

Apr. 28, 2009 (JP) ..... 2009-109767

(51) Int. Cl.

| | |
|---|---|
| ***F24C 7/02*** | (2006.01) |
| ***F24C 15/32*** | (2006.01) |
| ***F24C 15/00*** | (2006.01) |
| ***H05B 6/64*** | (2006.01) |
| ***H05B 6/70*** | (2006.01) |
| ***H05B 6/72*** | (2006.01) |

(52) U.S. Cl.

CPC ..... *F24C 15/327* (2013.01); *F24C 15/006* (2013.01); *H05B 6/6402* (2013.01); *H05B 6/642* (2013.01); *H05B 6/6479* (2013.01); *H05B 6/6485* (2013.01); *H05B 6/707* (2013.01); *H05B 6/725* (2013.01)

(58) Field of Classification Search

CPC ..... B65D 81/3453; A47J 36/027
USPC ..... 219/731, 725, 682, 687, 697, 707, 710, 219/713

See application file for complete search history.

(56) References Cited

U.S. PATENT DOCUMENTS 3,320,396 A * 5/1967 Boehm ..... 219/685
3,783,219 A * 1/1974 Tateda ..... 219/757
(Continued)

FOREIGN PATENT DOCUMENTS

JP 54-103371 U 7/1979
JP 5-106848 A 4/1993
(Continued)

*Primary Examiner* — David Angwin
*Assistant Examiner* — Jimmy Chou
(74) *Attorney, Agent, or Firm* — Birch, Stewart, Kolasch & Birch, LLP

(57) ABSTRACT

A cooking device includes a casing, a heating chamber (102) provided in the casing and having an opening on a front side thereof, and a heat shield member (122) for blocking heat that transfers from the heating chamber (102) toward the casing. At least a part of the heat shield member (122) is located in a position that enables the heat shield member (122) to receive water droplets dropping through between the heating chamber (102) and the casing (101). The configuration reduces the possibility that a motor (133) and other components located below the heating chamber (102) fails by becoming wet due to condensate water.

3 Claims, 7 Drawing Sheets

(56) References Cited

U.S. PATENT DOCUMENTS

| | | | | |
|---|---|---|---|---|
| 4,158,760 | A * | 6/1979 | Bowen et al. | 219/728 |
| 4,166,208 | A * | 8/1979 | Martel et al. | 219/728 |
| 4,366,357 | A * | 12/1982 | Satoh | 219/682 |
| 4,409,453 | A * | 10/1983 | Smith | 219/684 |
| 4,495,392 | A * | 1/1985 | Derby | 219/729 |
| 4,728,762 | A * | 3/1988 | Roth et al. | 219/730 |
| 5,242,375 | A * | 9/1993 | McDonough | 600/22 |
| 5,360,965 | A * | 11/1994 | Ishii et al. | 219/705 |
| 5,401,940 | A * | 3/1995 | Smith et al. | 219/679 |
| 5,525,782 | A * | 6/1996 | Yoneno et al. | 219/682 |
| 6,008,482 | A * | 12/1999 | Takahashi et al. | 219/687 |
| 6,040,564 | A * | 3/2000 | Ueda et al. | 219/682 |
| 6,232,587 | B1 * | 5/2001 | Kurita et al. | 219/682 |
| 6,437,304 | B2 * | 8/2002 | Ushijima et al. | 219/688 |
| 6,861,631 | B2 * | 3/2005 | Hahm et al. | 219/682 |
| 6,953,920 | B2 * | 10/2005 | Jeon | 219/682 |
| 7,049,568 | B2 * | 5/2006 | Jeong | 219/757 |
| 7,105,785 | B2 * | 9/2006 | Kanzaki et al. | 219/682 |
| 7,199,340 | B2 * | 4/2007 | Yamasaki et al. | 219/682 |
| 7,234,478 | B2 * | 6/2007 | Kanzaki et al. | 134/105 |
| 7,304,278 | B2 * | 12/2007 | Kanzaki et al. | 219/682 |
| 7,323,662 | B2 * | 1/2008 | Cho et al. | 219/401 |
| 7,326,893 | B2 * | 2/2008 | Kanzaki et al. | 219/682 |
| 7,645,966 | B2 * | 1/2010 | Hayakawa et al. | 219/756 |
| 7,867,534 | B2 * | 1/2011 | Sells et al. | 426/233 |
| 7,915,568 | B2 * | 3/2011 | Wang | 219/680 |
| 8,042,458 | B2 * | 10/2011 | Ueda et al. | 99/476 |
| 8,161,870 | B2 * | 4/2012 | Yamamoto et al. | 99/330 |
| 2001/0032549 | A1 * | 10/2001 | Fukushima et al. | 99/476 |
| 2002/0005401 | A1 * | 1/2002 | Meyer et al. | 219/413 |
| 2003/0230569 | A1 * | 12/2003 | Kanzaki et al. | 219/682 |
| 2004/0094542 | A1 * | 5/2004 | Kim et al. | 219/682 |
| 2005/0006382 | A1 * | 1/2005 | Hayakawa et al. | 219/682 |
| 2005/0040160 | A1 * | 2/2005 | Jeon | 219/682 |
| 2005/0087528 | A1 * | 4/2005 | Kanzaki et al. | 219/682 |
| 2006/0088301 | A1 * | 4/2006 | Kanzaki et al. | 392/386 |
| 2007/0187388 | A1 * | 8/2007 | Yamaguchi et al. | 219/401 |
| 2007/0221070 | A1 * | 9/2007 | Akashi et al. | 99/331 |
| 2009/0194092 | A1 * | 8/2009 | Shon et al. | 126/273 R |
| 2009/0272729 | A1 * | 11/2009 | Ando et al. | 219/401 |
| 2009/0321429 | A1 * | 12/2009 | Hyde et al. | 219/710 |
| 2010/0000992 | A1 * | 1/2010 | Hechler | 219/729 |

FOREIGN PATENT DOCUMENTS

| | | | | |
|---|---|---|---|---|
| JP | 2004-294050 | A | 10/2004 | |
| JP | 2007-3150 | A | 1/2007 | |
| JP | 2007003150 | A * | 1/2007 | F24C 7/02 |
| JP | 2008051360 | A * | 3/2008 | |

* cited by examiner

COOKING DEVICE

TECHNICAL FIELD

The present invention relates to a cooking device.

BACKGROUND ART

There has been a conventional cooking device disclosed in JP 2004-294050 A (PTL 1). The cooking device has a casing and a heating chamber provided in the casing and is capable of heating an object to be heated in the heating chamber by supplying steam into the heating chamber.

In the cooking device, when the object to be heated in the heating chamber is heated by steam, extra steam flows through an exhaust duct and is discharged out of the casing through an exhaust port on the casing.

In an event that steam in the exhaust duct leaks into the casing by some reason (such as damage to the exhaust duct) in the conventional cooking device, however, condensate water produced on inner wall surfaces of the casing and/or the like may drop onto outer wall surfaces of the heating chamber.

As a result, the condensate water having flowed down along the outer wall surfaces of the heating chamber may wet devices, electronic components and/or the like under the heating chamber.

Thus there has been a problem in that safety is reduced by a fear that the devices, the electronic components and/or the like located under the heating chamber may break down because of the condensate water.

On the other hand, a manufacturing cost may be increased if a drip receiver or tray for receiving the condensate water having flowed down along the outer wall surfaces of the heating chamber is provided in the casing in order to solve the problem.

CITATION LIST

Patent Literature

PTL1: JP 2004-294050 A

SUMMARY OF INVENTION

Technical Problem

An object of the invention is to provide a cooking device by which safety can be improved and by which the increase in the manufacturing cost can be suppressed.

Solution to Problem

A cooking device according to the present invention comprises:

a casing;

a heating chamber provided in the casing and having an opening on a front side thereof; and a heat shield member provided between the casing and the heating chamber to block heat that transfers from the heating chamber toward the casing, wherein at least a part of the heat shield member is placed in a position that enables the heat shield member to receive water droplets dropping through between the heating chamber and the casing.

According to the cooking device having the configuration, even if condensation occurs in the casing and if the condensate water drops along outer wall surfaces of the heating chamber, the condensate water from the outer wall surfaces of the heating chamber can be received by the heat shield member.

This reduces a risk that devices, electronic components and/or the like located under the heating chamber will fail by being wetted by the condensate water, which therefore increases safety of the cooking device.

Besides, an increase in the manufacturing cost can be suppressed because a drip receiver that is intended to only receive the condensate water from the outer wall surfaces of the heating chamber does not have to be provided in the casing.

In one embodiment, the cooking device further comprises a blower device arranged and configured to take in air from outside the casing and blow off the air into the casing, and an air blow path provided in the casing, through which the air blown off from the blower device flows. And the heat shield member is placed in the air blow path, and the air flowing in the air blow path passes through the heat shield member.

According to the cooking device of the embodiment, the heat shield member is placed in the air blow path, and the air flowing in the air blow path goes through the heat shield member, and thus the condensate water received by the heat shield member can be vaporized by being exposed to a current of the air.

This reduces a risk that the devices, the electronic components and/or the like under the heating chamber will fail by being wetted by the condensate water from the heat shield member.

In one embodiment, the cooking device further comprises a drip receiver detachably mounted on a lower front side of the casing. Also, the heat shield member has a drain opening that is positioned over the drip receiver, and a sloped surface continuous to the drain opening and sloped with respect to a horizontal surface, the sloped surface having greater heights on a side farther from the drain opening than those on a side nearer to the drain opening.

According to the cooking device of the embodiment, the sloped surface of the heat shield member has comparatively small heights on the side nearer to the drain opening and comparatively large heights on the side farther from the drain opening, so that the condensate water received by the heat shield member is guided by the sloped surface into the drain opening and dropped into the drip receiver.

Therefore, the condensate water from the outer wall surfaces of the heating chamber can be discarded with the drip receiver detached from the casing, so that deterioration in sanitary conditions in the casing is prevented.

In one embodiment, the cooking device further comprises a high-frequency wave supply device supplying high-frequency waves into the heating chamber. Also, the heat shield member has a cut-out part in which at least a part of the high-frequency wave supply device is accommodated.

According to the cooking device of the embodiment, because the heat shield member has a cut-out part in which at least a part of the high-frequency wave supply device is accommodated, degree of freedom for placement of the high-frequency wave supply device can be increased.

Effect of Invention

According to the present invention, the cooking device is configured such that at least a part of the heat shield member is placed in a position that enables the heat shield member to receive water droplets dropping through between the heating chamber and the casing. Thus, condensate water dropping from the outer wall surfaces of the heating chamber can be received by the heat shield member.

Thus, it is possible to reduce the possibility that devices, electronic components and/or the like located under the heating chamber will fail by being wetted by the condensate water, and therefore to increase safety of the cooking device.

Besides, an increase in the manufacturing cost can be suppressed because a drip receiver that is intended to only receive the condensate water from the outer wall surfaces of the heating chamber does not have to be provided in the casing.

DESCRIPTION OF EMBODIMENTS

Embodiments of the cooking device according to the present invention will be described in detail below in conjunction with the attached drawings.

Figure 1:
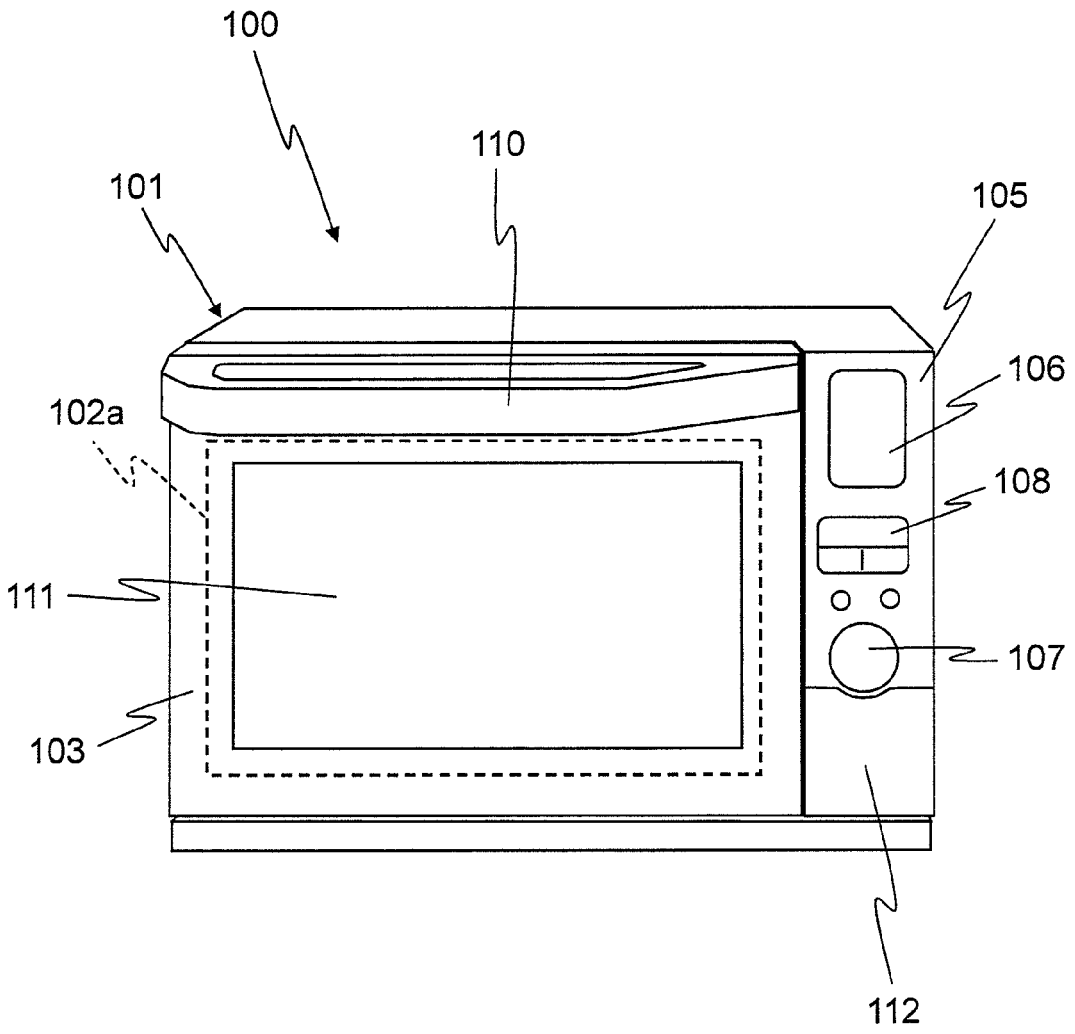
FIG. 1 is a schematic front view of a cooking device in accordance with an embodiment of the invention.

FIG. 1 is a schematic diagram of a cooking device in accordance with an embodiment of the invention, as seen looking from a front side of the cooking device. In FIG. 1, depiction of an exhaust duct 126 and a diluted-exhaust port 128, which will be described later, is omitted.

The cooking device includes a casing 101 shaped like a rectangular parallelepiped, a heating chamber 102 provided in the casing 101, and a door 103 that is pivotably mounted on a front side of the casing 101.

The door 103 pivots so as to open and close the front opening 102*a* of the heating chamber 102. A handle 110 is mounted on an upper part of the door 103. Heat-resistant glass 111 is provided generally at a center part of the door 103, so that a user can observe a state of inside of the heating chamber 102 through the heat-resistant glass 111. Onto a rear face of the door 103, packing 112 (not shown) made of heat-resistant resin is fixed so as to surround the heat-resistant glass 111.

The packing 112 is brought into intense and intimate contact with a peripheral part of the opening 102*a* of the heating chamber 102 by full closure of the door 103. Thus steam in the heating chamber 102 is prevented from leaking out from between the door 103 and the peripheral part of the opening 102*a* of the heating chamber 102.

An operation panel 105 is provided on a right side on the front face of the casing 101. The operation panel 105 has a liquid crystal display part 106, a knob 107, and a plurality of buttons 108. A front face of a water supply tank 113 is exposed below the knob 107. The water supply tank 113 can be attached to and detached from the casing 101.

Figure 2:
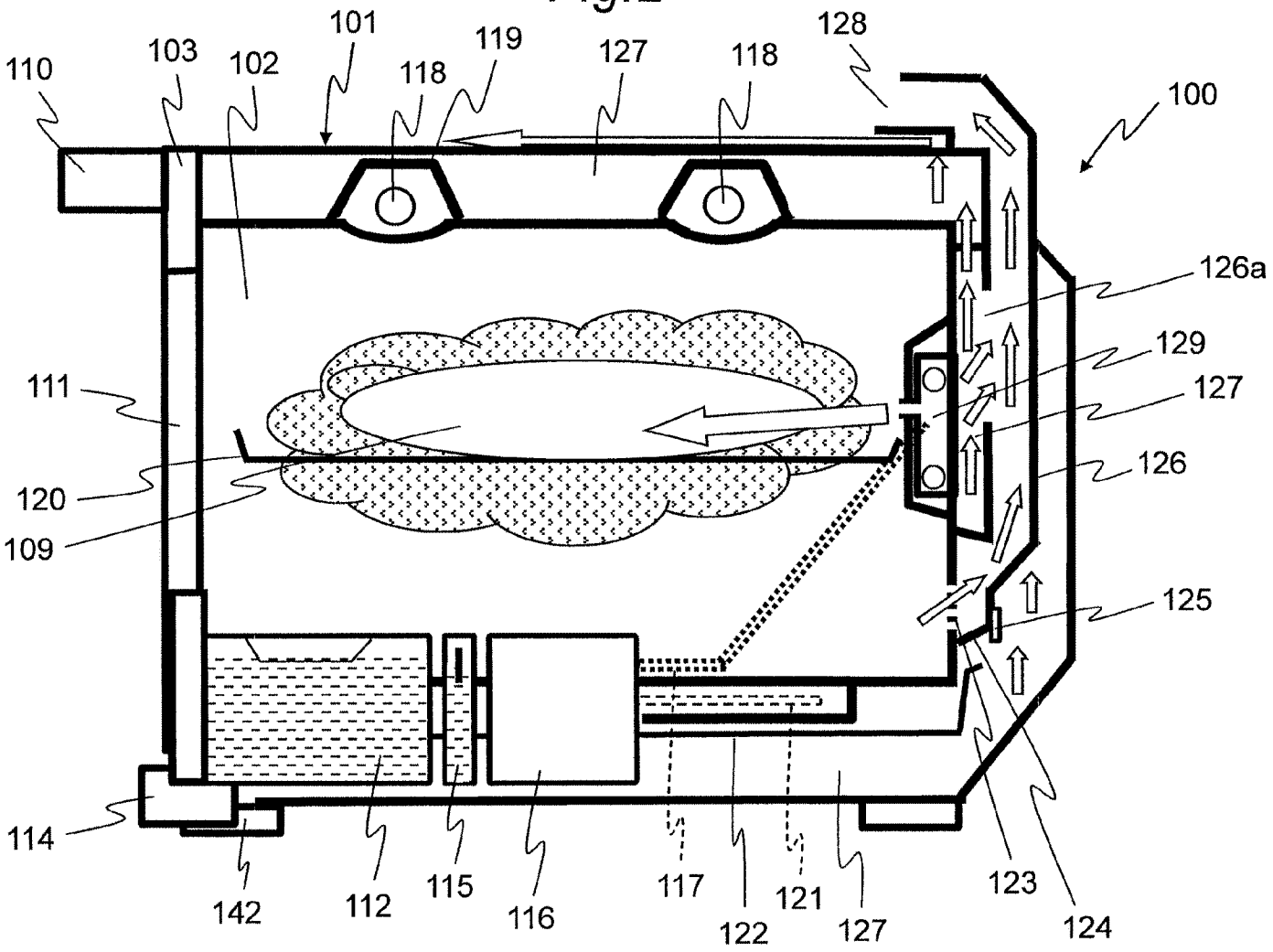
FIG. 2 is a schematic sectional view of the cooking device.

FIG. 2 is a schematic sectional view of the cooking device 100.

In FIG. 2, reference numeral 109 denotes an object to be cooked, reference numeral 114 denotes a drip receiver or tray, numeral 115 denotes a water level sensor, numeral 116 denotes a water supply pump, numeral 117 denotes a water supply pipe, numeral 118 denotes an upper heater, numeral 119 denotes an upper heater cover, numeral 120 denotes a tray, numeral 121 denotes a lower heater, numeral 122 denotes a heat shield plate, numeral 123 denotes an exhaust port, numeral 124 denotes an exhaust port cover, numeral 125 denotes an exhaust thermo-sensor, numeral 126 denotes an exhaust duct, numeral 126*a* denotes a cool-air introducing opening, numeral 127 denotes a cool-air path, and numeral 128 denotes a diluted-exhaust port. On a lower front side of the casing 101, two drip receiver guides 142 (only one is shown in FIG. 1) are mounted at a specified distance from each other. Though not shown in FIG. 2, a high-frequency wave supply device (see FIGS. 3 and 4) is also provided in the casing 101. The heat shield plate 122 is an example of a heat shield member. A cool-air path is an example of an air blow path.

The water supply pump 116 sucks water from the water supply tank 113 and delivers the water through the water supply pipe 117 to the steam producing unit 129. The steam producing unit 129 is capable of producing steam by heating the water from the water supply pump 116 and supplying the steam into the heating chamber 102, and capable of producing superheated steam by heating the steam and supplying the superheated steam into the heating chamber 102. Herein, the "superheated steam" refers to steam heated to a superheated state with temperatures of higher than 100° C.

The object to be cooked 109 can be heated by the steam or superheated steam from the steam producing unit 129 and/or can be heated by radiant heat from the upper heater 118 and the lower heater 121. A top wall of the heating chamber 102 is under the upper heater 118 and a bottom wall of the heating chamber 102 is above the lower heater 121, so that the upper heater 118 and the lower heater 121 are not exposed, or do not appear, in the heating chamber 102.

Figure 3:
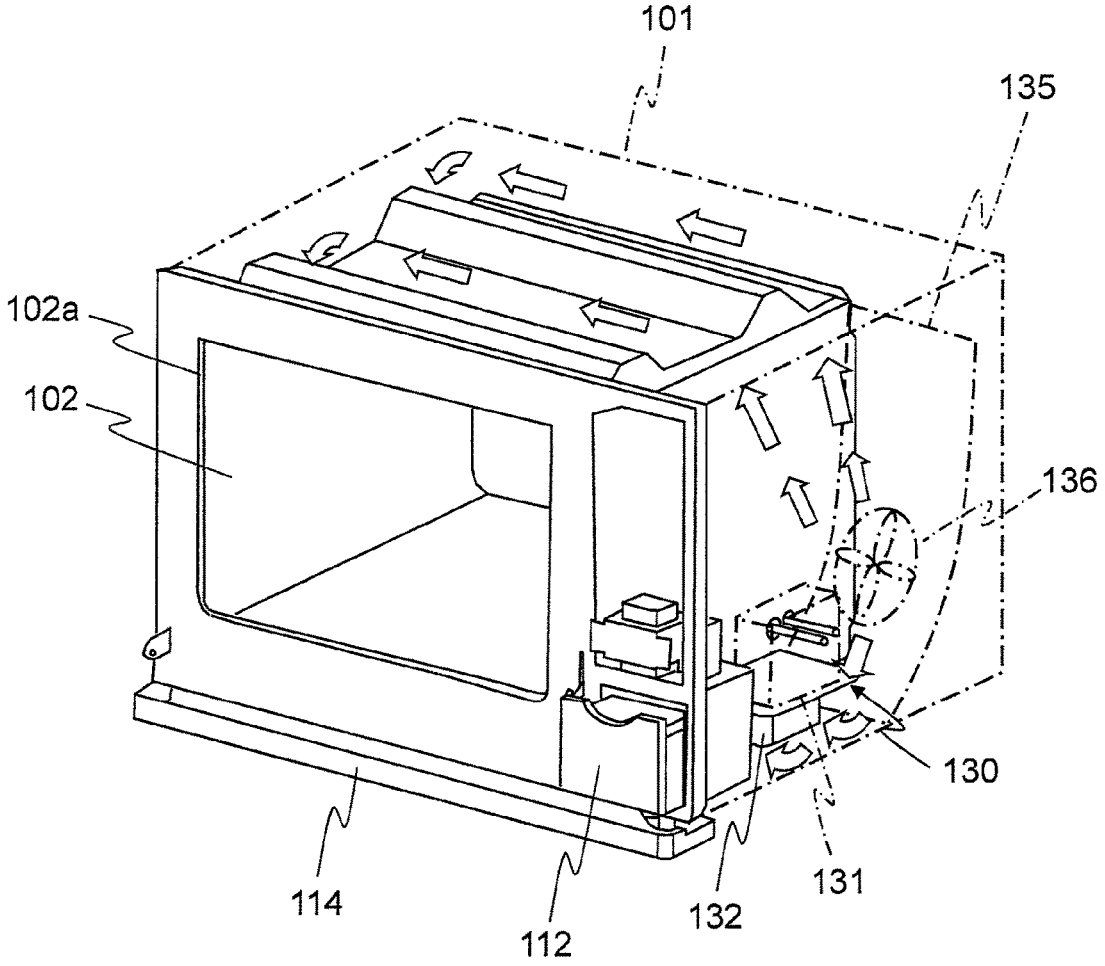
FIG. 3 is a schematic perspective view of parts of the cooking device as seen looking from above.
Figure 4:
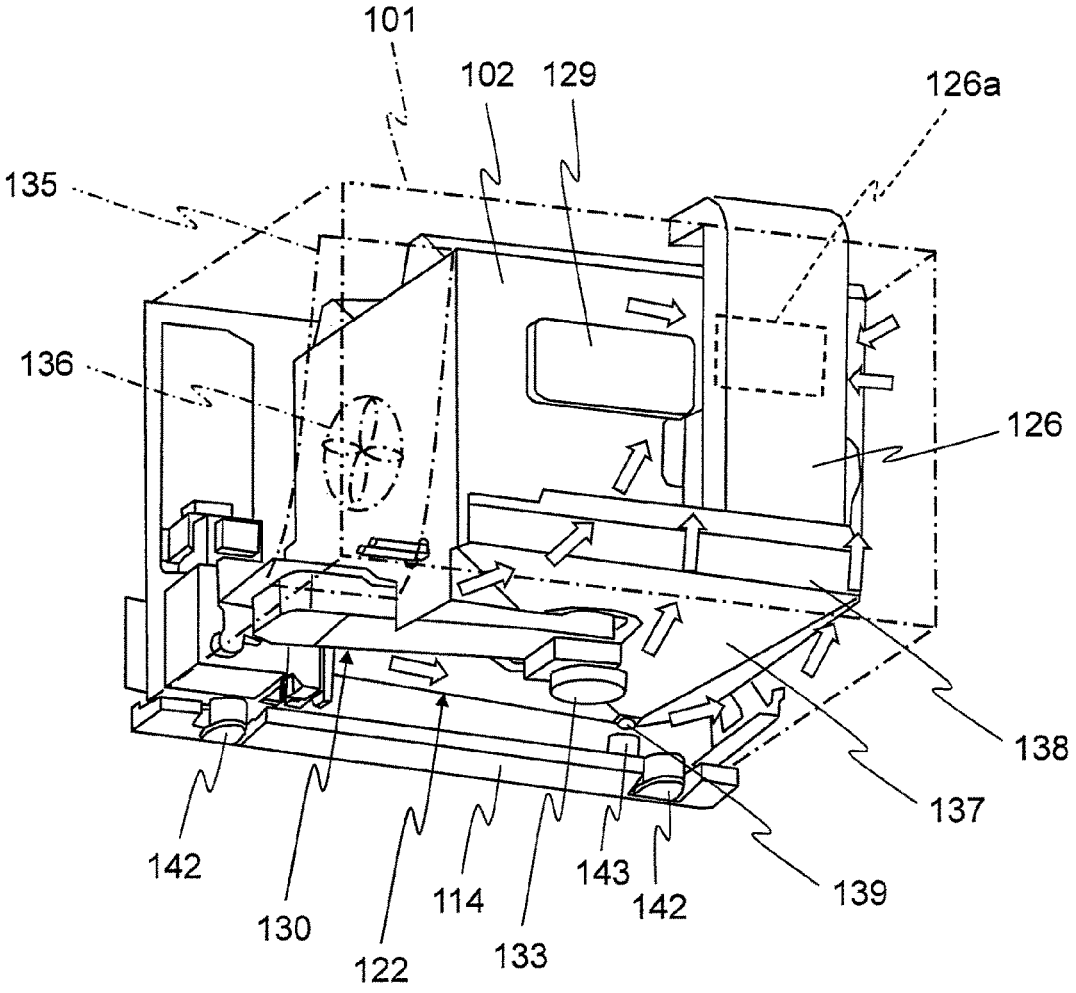
FIG. 4 is a schematic perspective view of parts of the cooking device as seen looking from below.

FIG. 3 is a schematic illustration of the cooking device 100 from which the door 103 has been removed, as seen looking diagonally from above. FIG. 4 is a schematic illustration of the cooking device 100 as seen looking diagonally from below.

As shown in FIGS. 3 and 4, the drip receiver 114 is detachably mounted on the lower front side of the casing 101. The drip receiver 114 is formed so as to extend from forward of the rear face (face oriented toward the heating chamber 102) of the door 103 fully closed to rearward of the rear face of the door 103 fully closed. When the door 103 is opened, consequently, condensate water having dropped along the rear face of the door 103 comes into the drip receiver 114.

The drip receiver guides 142 hold the drip receiver 114. The drip receiver 114 is able to be attached to and detached from the drip receiver guides 142, so that water accumulated in the drip receiver 114 can be discarded with the drip receiver 114 detached from the drip receiver guides 142. One of the drip receiver guides 142 is provided with a cylinder part 143 that is placed between the drip receiver 114 and a drain opening 139 on the heat shield plate 122.

The high-frequency wave supply device 130 has a magnetron 131, a waveguide 132, a motor 133, and a rotating antenna (not shown). Microwaves emitted from the magnetron 131 are guided by the waveguide 132 into a lower space in the heating chamber 102. The high-frequency waves guided into the lower space are radiated into the heating chamber 102 by the rotating antenna driven by the motor 133. Thus the object to be cooked 109 in the heating chamber 102 can be heated by the high-frequency waves. The rotating antenna is placed in a lower-heater housing chamber in which the lower heater 121 is housed.

The cool-air path 127 includes a space on a right side (i.e., a lateral side oriented toward the magnetron 131) of the heating chamber 102 and in front of a partition plate 135, a space above the heating chamber 102, a space under the heating chamber 102, a space on a left side of the heating chamber 102, and a space in rear of the heating chamber 102. Air flowing in the cool-air path 127 cools outer wall surfaces of the heating chamber 102, devices in the casing 101, and the like.

The partition plate 135 divides the space on the right side of the heating chamber 102 into two spaces. A blower device 136 is mounted on the partition plate 135. Electrical equipment (not shown) is placed in a space that is a part of the space on the right side of the heating chamber 102 and that is in front of the partition plate 135.

The blower device 136 takes in air from outside the casing 101 through the space in rear of the partition plate 135 and blows off the air into the space in front of the partition plate 135. The air the blower device 136 blows off cools the electrical equipment on the right side of the heating chamber 102. A portion of the air having cooled the electrical equipment flows through the space between an upper part of the casing 101 and an upper part of the heating chamber 102 toward the space on the left side of the heating chamber 102 and the space in rear of the heating chamber 102. Another portion of the air having cooled the electrical equipment flows through the space between a lower part of the casing 101 and a lower part of the heating chamber 102 toward the space on the left side of the heating chamber 102 and the space in rear of the heating chamber 102. A portion of the air having flowed into the space in rear of the heating chamber 102 enters through the cool-air introducing opening 126*a* into the exhaust duct 126 and merges with exhaust gas in the exhaust duct 126. A portion of the air having flowed into the space on the left side of the heating chamber 102 also flows into the space in rear of the heating chamber 102 and merges with the exhaust gas in the exhaust duct 126. Though not shown, air intakes communicating with the space in rear of the partition plate 135 are provided on the casing 101. Not all the air the blower device 136 blows off enters into the exhaust duct 126, and a portion of the air is discharged to outside through other openings (not shown) on the casing 101.

Figure 5:
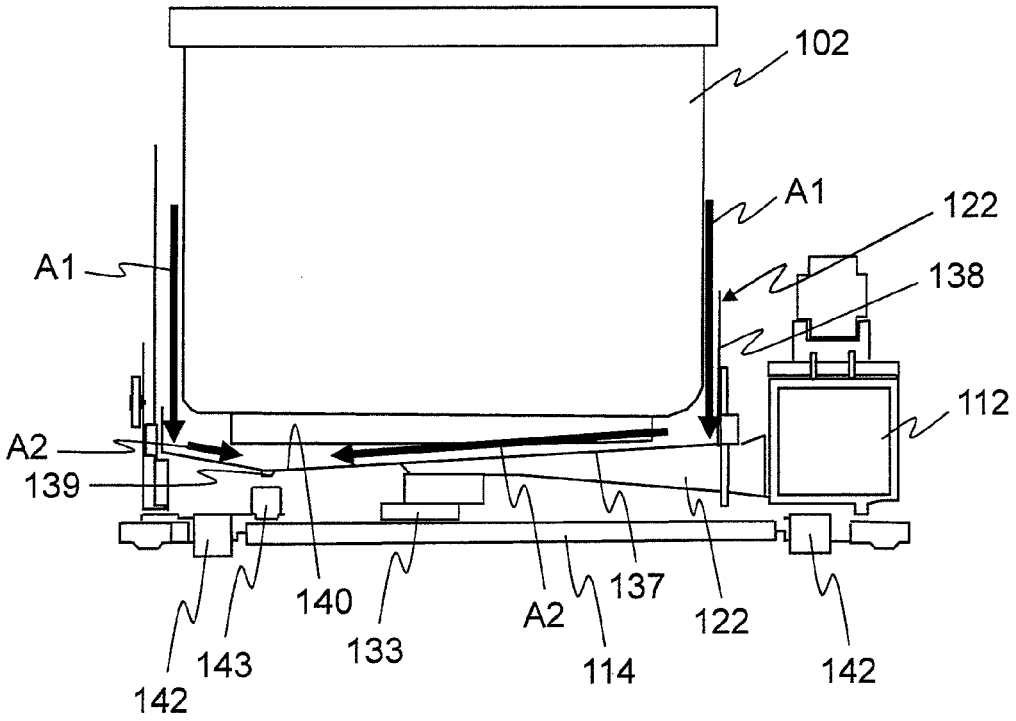
FIG. 5 is a schematic sectional view of the cooking device.
Figure 6:
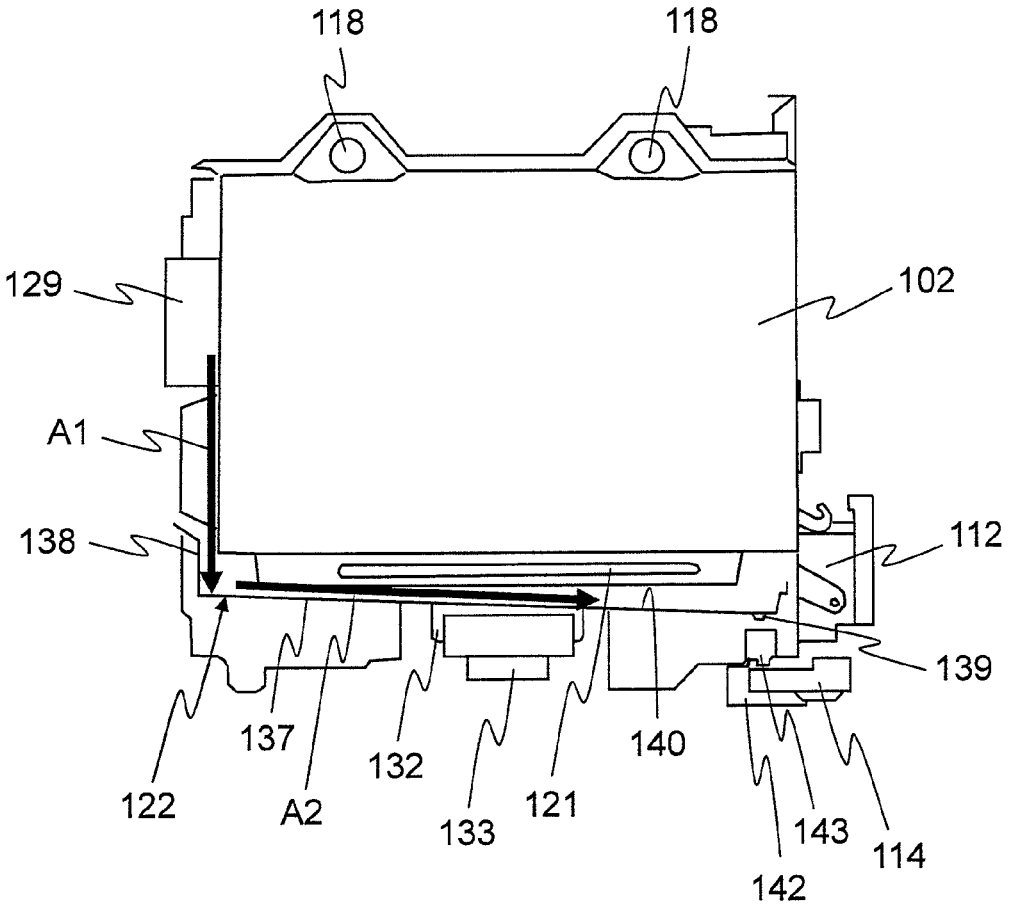
FIG. 6 is another schematic sectional view of the cooking device.

FIG. 5 is a schematic section of the cooking device 100 as seen looking from the front side thereof. FIG. 6 is a schematic section of the cooking device 100 as seen looking from the left side thereof. In FIGS. 5 and 6, the exhaust duct 126 and the diluted-exhaust port 128 are not shown.

As shown in FIGS. 5 and 6, the heat shield plate 122 blocks heat that transfers from the heating chamber 102 toward the casing 101. The heat shield plate 122 has a bottom part 137 and peripheral wall parts 138 stood at the edges of the bottom part 137. The heat shield plate 122 is placed at a specified distance from the heating chamber 102. The bottom part 137 of the heat shield plate 122 is placed in a position facing a bottom part of the heating chamber 102. A space between the bottom part 137 of the heat shield plate 122 and the bottom part of the heating chamber 102 forms a part of the cool air path 127, and air from the blower device 136 passes through the space. On the other hand, the peripheral wall parts 138 of the heat shield plate 122 are placed in positions facing lower parts of each of a front wall, both side walls and a rear wall of the heating chamber 102. Thus a part of the heat shield plate 122 is placed in a position that enables the heat shield member 122 to receive water droplets dropping through between the heating chamber 102 and the casing 101.

Figure 7:
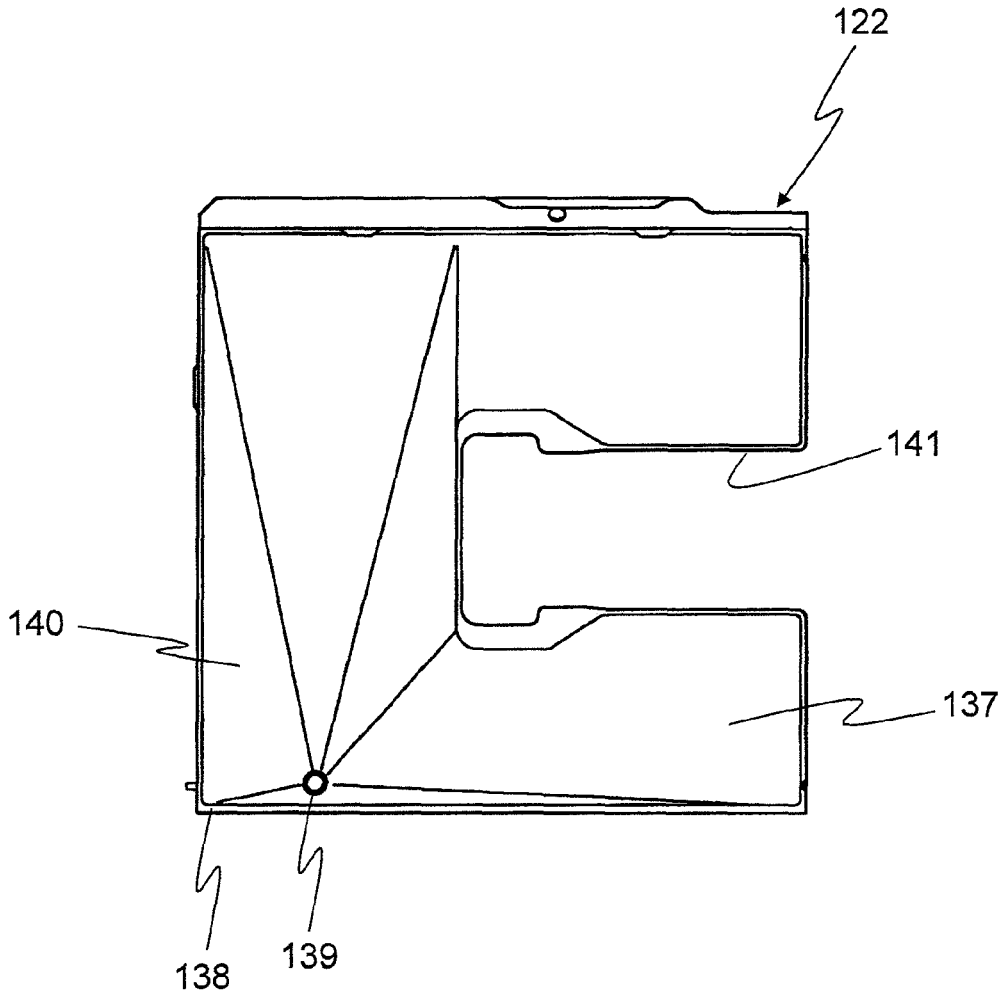
FIG. 7 is a schematic plan view of a heat shield plate of the cooking device.

FIG. 7 is a schematic illustration of the heat shield plate 122 as seen looking from above.

The heat shield plate 122 has the drain opening 139 positioned over the cylinder part 143 of the drip receiver guide 142 and a sloped surface 140 that is continuous to the drain opening 139 and sloped with respect to a horizontal surface. The heat shield plate 122 is provided with a cut-out part 141 that opens on the right side of the heating chamber 102.

The sloped surface 140 forms a part of an upper surface of the bottom part 137 of the heat shield plate 122 and extends to an upper end of the drain opening 139. The sloped surface 140 is formed so as to have smaller heights in positions nearer to the drain opening 139. That is, a site on the sloped surface 140 that is nearer to the drain opening 139 has a smaller height than a site on the sloped surface 140 that is farther from the drain opening 139.

An edge part of the cut-out part 141 is bent upward so that condensate water received by the heat shield plate 122 may not drop downward through a space in the cut-out part 141. As shown in FIGS. 3 and 4, a greater part of the waveguide 132 of the high-frequency wave supply device 130 is accommodated in the cut-out part 141.

When condensation occurs on inner surfaces of the casing 101 and when condensate water drops from the inner surfaces onto the outer wall surfaces of the heating chamber 102, or when condensation occurs on the outer wall surfaces of the heating chamber 102, in the cooking device 100 having the above configuration, the condensate water flows along the outer wall surfaces of the heating chamber 102 and drops onto the heat shield plate 122, as shown by arrows A1 in FIGS. 5 and 6.

This reduces a risk that the motor 133 and other devices located under the heating chamber 102 will fail by being wetted by the condensate water and therefore increases safety.

Besides, an increase in manufacturing cost can be suppressed because an additional drip receiver that only receives condensate water from the outer wall surfaces of the heating chamber 102 does not have to be provided in the casing 101, in addition to the drip receiver 114.

The heat shield plate 122 is placed in the cool air path 127, and thus air flowing in the cool air path 127, that is, the air discharged from the blower device 136 passes through the heat shield plate 122, as shown by thick arrows in FIGS. 3 and 4. Then a portion of the air discharged from the blower device 136 flows through the space between the lower part of the heating chamber 102 and the heat shield plate 122. Even if the condensate water is left on the heat shield plate 122, accordingly, the condensate water can be vaporized by the air.

As a result, the risk can further be reduced that the motor 133 and other devices or parts located under the heating chamber 102 will fail by being wetted by the condensate water from the heat shield plate 122.

The sloped surface 140 of the heat shield plate 122 has comparatively small heights on a side nearer to the drain opening 139 and comparatively large heights on a side opposite to, i.e., farther from the drain opening 139, so that the condensate water having dropped onto the heat shield plate 122 flows along the sloped surface 140 into the drain opening 139 as shown by arrows A2 in FIGS. 5 and 6. Then the condensate water drops from the drain opening 139 through the cylinder part 143 of the drip receiver guide 142 into the drip receiver 114.

Therefore, the condensate water from the outer wall surfaces of the heating chamber 102 can be discarded with the drip receiver 114 detached from the casing 101, so that deterioration in sanitary conditions in the casing 101 can be prevented.

The greater part of the waveguide 132 of the high-frequency wave supply device 130 is accommodated in the heat shield plate 122, and thus degree of freedom for placement of the high-frequency wave supply device 130 can be increased.

The condensate water in the drain opening 139 can reliably be guided into the drip receiver 114 by the cylinder part 143 of the drip receiver guide 142.

Though only a part of the heat shield plate 122 is placed in the position in which water droplets dropping through between the heating chamber 102 and the casing 101 are able to be received by the heat shield plate 122 in the embodiment, the entirety of a heat shield plate may be placed in the position in which water droplets dropping through between the heating chamber 102 and the casing 101 are able to be received by the heat shield plate 122. As such a heat shield plate, for instance, the heat shield plate 122 from which the peripheral wall parts 138 have been removed may be used. The heat shield plate is an example of the heat shield member.

Though the condensate water having dropped onto the heat shield plate 122 flows along the sloped surface 140 into the drain opening 139 in the embodiment, a weir part may be provided in vicinity of the peripheral wall parts 138 on the upper surface of the bottom part 137 so that the condensate water having dropped onto the heat shield plate 122 may not flow along the sloped surface 140 into the drain opening 139. In this configuration, drain hole or holes may be provided on the bottom part 137 between the weir part and the peripheral wall parts 138, and the condensate water may be guided through the drain hole(s) to the outside of the casing 101 or into the drip receiver 114.

The heat shield plate 122 that is generally shaped like a vessel is provided between the casing 101 and the heating chamber 102 in the embodiment, whereas a heat shield plate that is generally shaped like a plate may be provided between the bottom part of the casing 101 and the bottom part of the heating chamber 102, for instance. Condensate water from the outer wall surfaces of the heating chamber 102 can be received even by such a heat shield plate that is generally shaped like a plate.

Though the drain opening 139 is provided on the heat shield plate 122 in the embodiment, the drain opening 139 may be omitted. In the device in which the drain opening 139 is not provided on the heat shield plate 122, condensate water received by the heat shield plate 122 can be dried by heat from the heating chamber 102 or air from the blower device 136.

Condensate water in the drain opening 139 is dropped through the cylinder part 143 of the drip receiver guide 142 into the drip receiver 114 in the embodiment, whereas the condensate water in the drain opening 139 may be dropped directly into the drip receiver 114.

Though the steam producing unit 129 that has a function of producing superheated steam is installed in the cooking device 100 in the embodiment, a steam producing unit that only produces steam and that does not have the function of producing superheated steam may be installed in the cooking device 100.

The invention is applicable not only to microwave ovens that use superheated steam but also to cooking devices such as ovens, cooking stoves, microwave ovens or IH cooking heaters that do not use superheated steam, as well as to cooking devices such as ovens, cooking stoves or IH cooking heaters that use superheated steam, for instance.

According to the cooking device of the invention, healthy cooking can be performed by use of superheated steam or saturated steam in cooking heaters (such as IH heaters, electric cooking stoves such as electric heaters, or gas cooking stoves), microwave ovens or the like. In the cooking device of the invention, for instance, superheated steam or saturated steam having a temperature not lower than 100° C. is supplied onto surfaces of food, the superheated steam or saturated steam deposited onto the surfaces of the food condenses and gives the food a great quantity of latent heat of condensation, therefore heat can efficiently be transmitted to the food. The condensate water is deposited on the surfaces of the food, and salt content, oil content and the like drop with the condensate water, so that salt content, oil content and the like in the food can be reduced. Furthermore, the heating chamber is filled with the superheated steam or saturated steam so as to be in a low oxygen state, and thus cooking by which oxidation of the food is suppressed can be performed. Here, the "low oxygen state" refers to a state in which the oxygen content in the heating chamber is equal to or less than 10 volume percent (e.g., 2-3 volume percent).

A cooking device according to an aspect of the present invention comprises:

a casing;

a heating chamber provided in the casing and having an opening on a front side thereof; and a heat shield member provided between the casing and the heating chamber to block heat that transfers from the heating chamber toward the casing, wherein the heat shield member is placed at least below the heating chamber and has a shape that enables the heat shield member to receive water droplets dropping along outer wall surfaces of the heating chamber.

According to the cooking device having the configuration, even if condensation occurs in the casing and if the condensate water drops along the outer wall surfaces of the heating chamber, the condensate water from the outer wall surfaces of the heating chamber can be received by the heat shield member.

This reduces a risk that devices, electronic components and/or the like located under the heating chamber will fail by being wetted by the condensate water, which therefore increases safety of the cooking device.

Besides, an increase in the manufacturing cost can be suppressed because a drip receiver that is intended to only receive the condensate water from the outer wall surfaces of the heating chamber does not have to be provided in the casing.

REFERENCE SIGNS LIST

100 cooking device
101 casing
102 heating chamber
114 drip receiver
122 heat shield plate
127 cool-air path
130 high-frequency wave supply device
136 blower device
139 drain opening
140 sloped surface
141 cut-out part

The invention claimed is:

1. A cooking device comprising:

an outer casing;

an inner casing having a top wall, a bottom wall, front wall, back wall and side walls, the inner casing forming a heating chamber provided within the outer casing and having an opening on the front wall;

a heat shield member provided between the outer casing and the heating chamber to block heat that transfers from the heating chamber toward the outer casing;

a blower device arranged and configured to take in air from outside the outer casing and blow off the air into the outer casing; and an air blow path provided in the outer casing, through which the air blown off from the blower device flows, wherein at least a part of the heat shield member is placed below the heating chamber such that the heat shield member is allowed to receive water droplets dropping through between the heating chamber and the outer casing, and the cooking device has a structural arrangement such that the air blow path includes a first space between said at least a part of the heat shield member placed below the heating chamber and a bottom of the heating chamber and a second space between said at least a part of the heat shield member placed below the heating chamber and the outer casing, wherein the heat shield member has a peripheral wall part provided between the inner casing and the outer casing and provided in a position that extends beyond a perimeter defined by the walls of the inner casing and facing a lower part of the side walls of the inner casing.

2. The cooking device as claimed in claim 1, further comprising:

a drip receiver detachably mounted on a lower front side of the outer casing, wherein the heat shield member has:

a drain opening that is positioned over the drip receiver; and a sloped surface continuous to the drain opening and sloped with respect to a horizontal surface, the sloped surface having greater heights on a side farther from the drain opening than those on a side nearer to the drain opening.

3. The cooking device as claimed in claim 1, further comprising:

a high-frequency wave supply device supplying high-frequency waves into the heating chamber, wherein the heat shield member has a cut-out part in which at least a part of the high-frequency wave supply device is accommodated.

* * * * *